US005860261A

United States Patent [19]

LeBlanc

[11] Patent Number: 5,860,261

[45] Date of Patent: Jan. 19, 1999

[54] BUILDING BLOCK RETAINER APPARATUS

[76] Inventor: Harry B. LeBlanc, 2710 7th St., Lake Charles, La. 70601

[21] Appl. No.: 729,278

[22] Filed: Oct. 10, 1996

[51] Int. Cl.[6] ..... E04F 13/08

[52] U.S. Cl. ..... 52/385; 52/434; 52/562; 52/712; 52/745.09; 52/745.1; 52/745.13

[58] Field of Search ..... 52/712, 562, 434, 52/385, 745.09, 745.1, 745.13

[56] References Cited

U.S. PATENT DOCUMENTS

| | | | |
|---|---|---|---|
| 2,223,721 | 12/1940 | Ernstoff | 52/385 |
| 3,181,278 | 5/1965 | Jones | 52/712 |
| 3,321,883 | 5/1967 | Pascucci | 52/434 X |
| 4,033,083 | 7/1977 | Fritz et al. | 52/385 X |
| 4,662,140 | 5/1987 | Porter et al. | 52/385 |
| 4,890,433 | 1/1990 | Funaki | 52/385 X |
| 5,159,795 | 11/1992 | Colen | 52/712 X |

*Primary Examiner*—Christopher Kent
*Attorney, Agent, or Firm*—Jesse D. Lambert

[57] ABSTRACT

An apparatus for retaining building blocks, such as bricks and cement blocks, to a wall structure to form a suitable veneer, without the use of mortar or other binding agent between the blocks. The apparatus is also suitable for use as a brick laying guide in the construction of conventionally mortar and brick wall. The apparatus comprises a base plate attached to the wall structure by nailing, screwing, or other like means. Attached to the base plate and extending generally perpendicularly outward are at least two retainer arms, the inner faces of said arms opposing one another and forming a retaining space therebetween for closely receiving the building block. Each of the arms further comprises at least one prong extending into said retaining space. A brick or other building block, having holes extending vertically therethrough, is inserted into the retaining space to a sufficient depth that the prongs extend into the holes in the brick, thereby holding the brick securely in place at a desired distance from the wall structure and from adjacent bricks. The apparatus may be formed out of sheet metal or other like material, and may have retainer arms attached to a single base plate in sufficient number to hold multiple building blocks.

3 Claims, 6 Drawing Sheets

BUILDING BLOCK RETAINER APPARATUS

BACKGROUND AND SUMMARY OF THE INVENTION

The present invention relates to apparatus used to form wall veneers from building blocks, such as conventional bricks and cement blocks. With further specificity, the present invention relates to apparatus for forming wall veneers of bricks or other like materials without the use of mortar or other bonding materials between the blocks to bind them together, by retaining said bricks to a wall structure at a desired distance from said wall structure and at a desired distance between the bricks. In addition, the present invention relates to apparatus useful for maintaining the proper alignment of bricks during the construction of conventional mortar and brick walls.

Various devices have been developed to aid masons in constructing conventional brick or building block wall veneers. Such veneers are formed by layers of bricks placed one atop another with mortar or other binding agent therebetween to hold the bricks together. Forming such veneers, by conventional means, requires significant skill and expense in that typically a skilled mason is needed to form brick walls that are plumb and level, with the attendant expense to hire such a skilled person. While various apparatus have been developed to simplify the construction of brick veneer walls, all such apparatus are intended to be used by a skilled mason in constructing brick walls by conventional methods of arranging rows of bricks with mortar therebetween to bond the bricks together, as described hereinafter. Not disclosed is a means by which a person unskilled in the art of masonry or bricklaying can form brick veneer walls or wall sections without the use of mortar to bind the bricks together, and can do so themselves at relatively low cost.

One common application of brick laying projects is in making wall panels for decorative purposes, where the appearance of a whole or partial brick wall is desired at relatively low cost.

The prior art discloses several means intended for use by masons as alignment devices in constructing conventional mortar and brick walls. For example, U.S. Pat. No. 3,69/8089 to Huston (Oct. 17, 1972), and U.S. Pat. No. 5,125,162 to Prebeck (Jun. 30,1992) disclose clip means which are attached to bricks to provide an anchor for attachment of an alignment line. Typically, clips of this nature are fastened to bricks near the opposite ends of a brick wall, and a line stretched tautly therebetween to provide an alignment guide for further bricklaying.

However, alignment devices of the type disclosed in Huston and Prebeck depend on an unmoving anchor brick to which the clip means is attached. As the line is tightened to produce a taut alignment guide, such clips tend to slip from the anchor bricks to which they are attached and to shift the brick from its initial location, in the process disrupting the alignment of the line, as it is no longer taut. With the line no longer taut, it is not possible to use it as a guide for laying a level brick row.

The present invention provides a solid, secure anchor point for alignment lines. Instead of relying on the mortar to hold the anchor brick in place, with clip means attaching the line to the brick, the present invention provides a means for solidly anchoring the guide bricks in place and for secure attachment of the alignment line to an unmoving point. After mounting the apparatus on a wall structure, which is typically wood, by nails, screws or other like fastening means, a brick is inserted and locked into place in the apparatus. In such manner, a pair of bricks at either end of a wall section may be mounted to serve as anchor bricks, then an alignment line is attached therebetween by tying the alignment line to the anchor bricks or to the retainer apparatus of the present invention. Then, two or more bricks are installed at the upper corners of the wall structure, plumb with the anchor bricks. Alignment lines are run from the lowermost to the uppermost retainer apparatus to provide plumb lines. In such manner, taut, unmoving alignment lines are provided to simplify the task of laying the next row of bricks at an equal elevation to that of the anchor bricks, and to ensure that the brick corners are plumb.

It is therefore an object of the present invention to provide an apparatus for retaining bricks and other building blocks on a wall structure to form a brick veneer. Another object is to provide apparatus that will retain bricks to form a brick veneer without the use of mortar between said bricks, and to provide a means of forming a brick veneer that may be implemented by persons unskilled in the art of bricklaying. Still another object of the present invention is to provide an apparatus for retaining bricks on a wall structure to form a brick veneer over said wall, said apparatus amenable to mass production from relatively low cost materials, and that can be made in various embodiments to suit particularized needs. Yet another object of the present invention is to provide a simple apparatus for installation of one or more "anchor" or "guide" bricks on a wall structure, with said anchor bricks serving as the reference point for installation of the remaining bricks in that row at equal elevation.

DESCRIPTION OF THE PREFERRED EMBODIMENT

With reference to FIGS. 1 through 5, one embodiment of the present invention is described herein.

Figure 1:
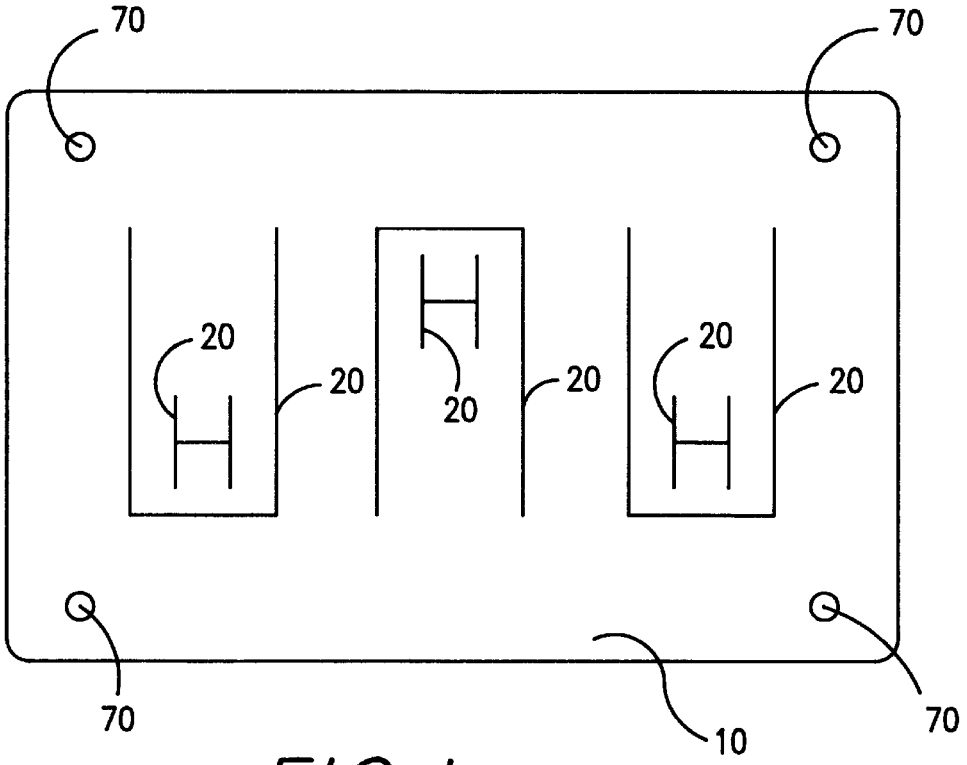
FIG. 1 is a front view of sheet material used to form one embodiment of the apparatus, showing cut-outs for forming the various parts of the apparatus.

While many methods of constructing the apparatus are possible, the apparatus may be formed economically and efficiently out of flat, sheetlike material such as mild steel, aluminum or the like. Alternatively, the apparatus may be formed from sheetlike plastic materials having the required strength and resilience properties. FIG. 1 is a front view of a sheet 10 of an appropriate material. Cut-outs, represented by lines 20, are made in the material in an appropriate shape to ultimately form the retainer arms and prongs of the apparatus. While said cut-outs may be made by a stamping process with appropriately shaped dies to fully penetrate the material, other means of cutting may be used, such as saws, torch cutting, etc.

Figure 2:
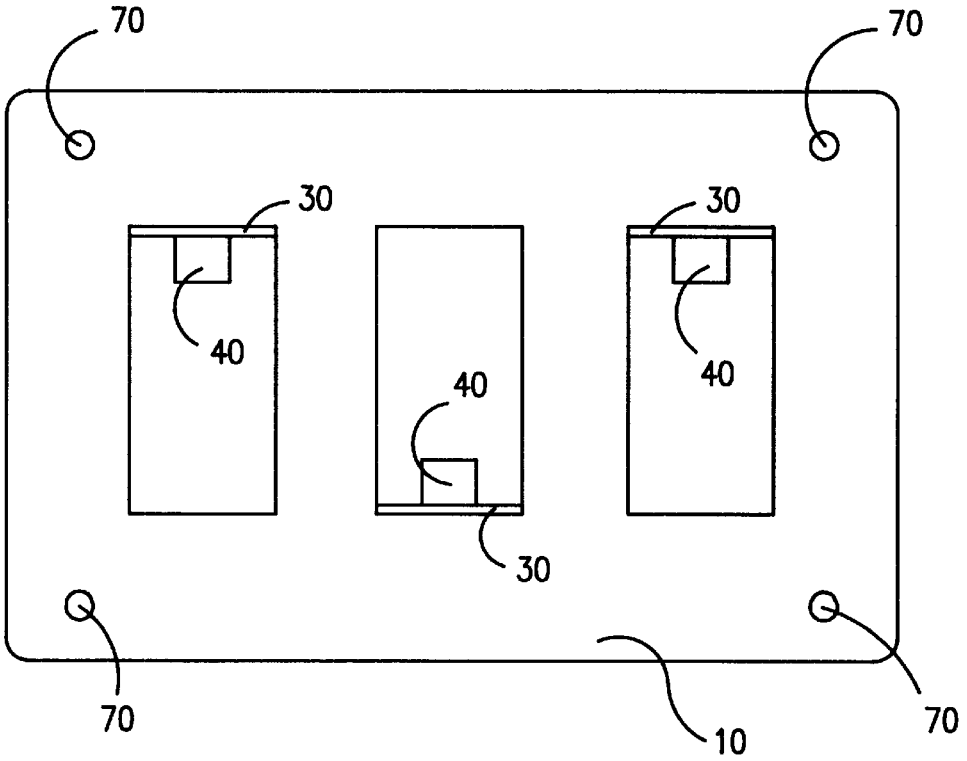
FIG. 2 is a front view of one embodiment of the apparatus of the present invention.
Figure 3:
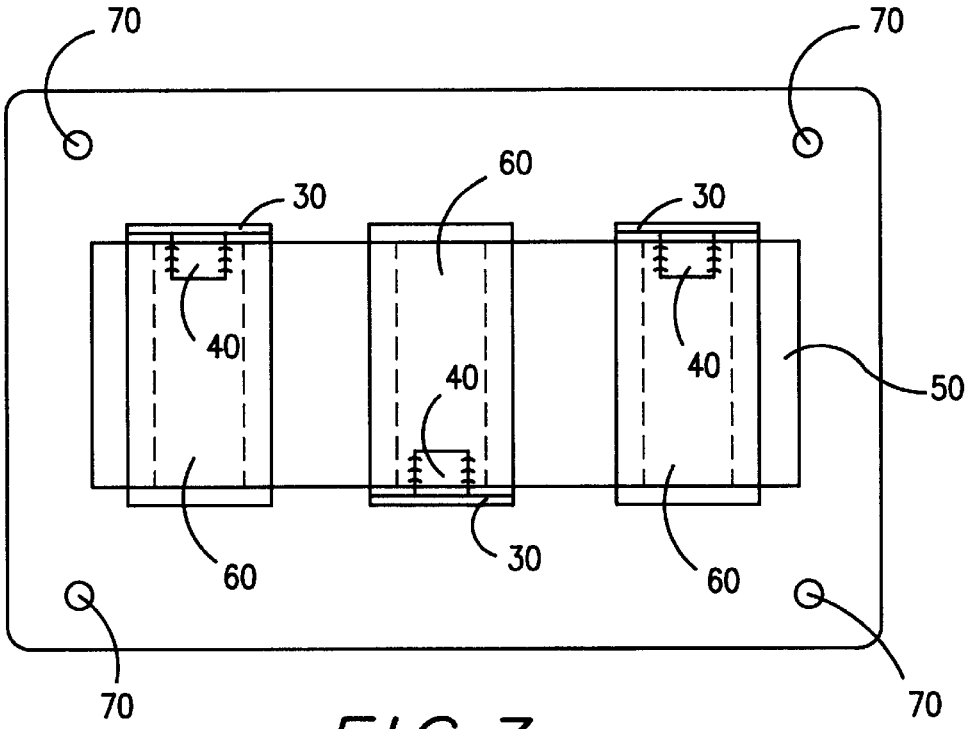
FIG. 3 is a front view of one embodiment of the apparatus, showing a brick retained therein.

FIG. 2 is a front view of the apparatus after forming from sheet material. After cutting, the sections of the material forming the retainer arms must be bent outward from the remainder of the sheet to a position generally perpendicular to the remainder, thereby forming at least two opposing retainer arms 30 with a retaining space therebetween. Such forming may be effected by stamping or punching means well known in the art. Retainer arms 30 have sufficient space therebetween to accommodate a building block, such as a brick or concrete block, of the desired size, as further described below. In similar fashion, at least one prong 40 in each retainer arm is bent outward so as to be generally perpendicular to the remainder of retainer arm 30, with prongs 40 pointed generally toward one another and displaced into said retaining space. FIG. 3 is a front view of the apparatus with brick 50 retained in place by retainer arms 30 and prongs 40. Dotted lines represent holes 60 in brick 50, typical in most bricks. While a brick having three holes therethrough is shown in FIG. 3, it is understood that the invention may be used to secure bricks or concrete building blocks having a larger or smaller number of holes therein, with an appropriate change in the number of retainer arms 30 as necessary.

Figure 4:
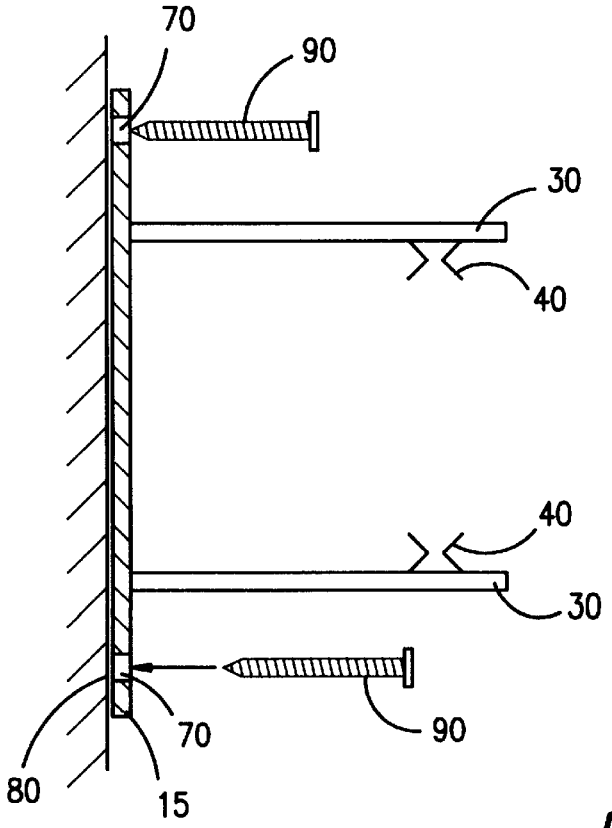
FIG. 4 is a side view of one embodiment of the present invention.

FIG. 4 is a side view of the apparatus. Retainer arms 30 are shown extending substantially perpendicular to base plate 15, although it is understood that various embodiments are possible with retainer arms 30 extending at angles other than perpendicular from base plate 15, then having a section proximal to the distal ends of retainer arms 30 parallel to one another for receiving the brick or concrete block. Fastening means 90, which may be nails, screws, or the like, may be used to fasten base plate 15 to wall structure 80.

Figure 5:
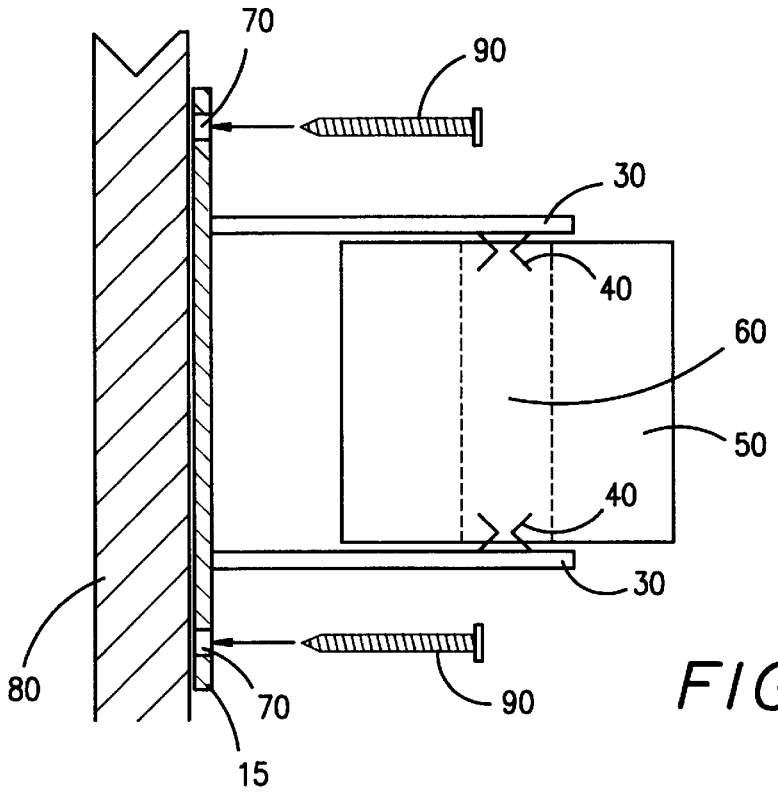
FIG. 5 is a side view of one embodiment of the present invention, showing a brick retained therein.

FIG. 5 is a side view of the apparatus showing brick 50 retained by the apparatus.

To use the apparatus, base plate 15 is fastened to wall structure 80 by suitable fastening means 90 inserted through holes 70. Although the apparatus is typically fastened so that a brick retained thereby will be horizontal when viewed from the front, such alignment is not required, and the apparatus may be fastened at any angle to produce rows of bricks at desired angles other than horizontal. After fastening to wall structure 80, brick 50 is inserted into the retainer space between retainer arms 30, with holes 60 aligned with prongs 40. While retainer arms 30 are sufficiently far apart to permit brick 50 to fit therebetween, the spacing between prongs 40 is somewhat smaller than the vertical dimension of brick 50, so that an interference fit exists therebetween. Insertion of brick 50 then forces prongs 40 and retainer arms 30 apart, then when prongs 40 enter holes 60, retainer arms 30 flex back down to insert prongs 40 into holes 60 and securely hold brick 50. The apparatus is therefore advantageously made of a material having sufficient resilience to permit retainer arms 30 to flex outward and then return to their original positions, with the spacings between said retainer arms, the length of said prongs, and the spring yield of the retainer arms appropriately made so that a brick, upon insertion into the retainer space from the front of the apparatus, will force retainer arms 30 apart due to the interference with prongs 40, then when prongs 40 are able to protrude into holes 60 in bricks 50, retainer arms 30 spring back to their original positions, thereby holding brick 50 securely therebetween.

Figure 6:
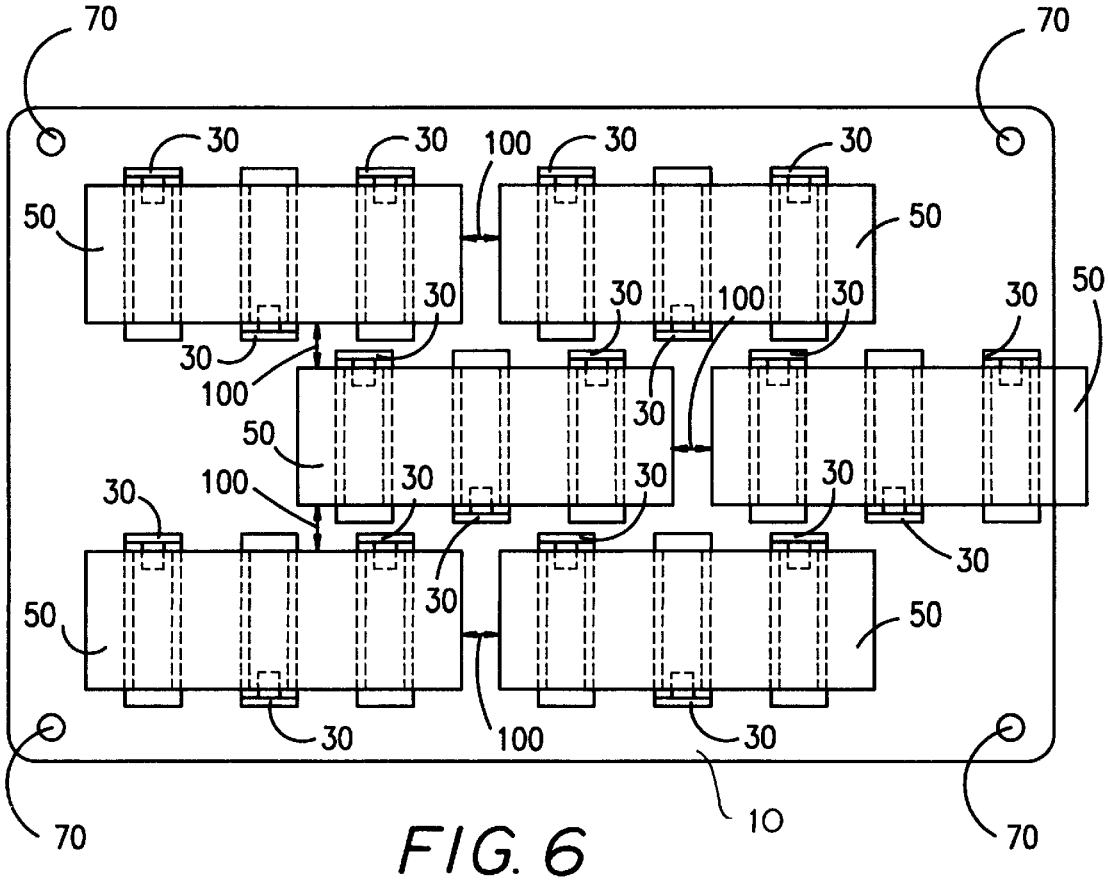
FIG. 6 is a front view of another embodiment of the present invention, capable of retaining multiple bricks on a wall structure.

In an alternative embodiment, the apparatus may be made in such fashion to hold more than one brick. FIG. 6 shows an embodiment wherein multiple bricks are retained in a desired spacing, thereby forming a desired pattern in the brick veneer. It should be noted that the spacing between sets of retainer arms 30 may be such as to create a desired gap 100 between bricks 50. Gaps 100 may be such as to be effectively non-existent, with bricks 50 touching one another, or may be any larger spacing. One alternative of gap 100 is to make said gap approximately equal to the spacing between conventionally mortared bricks. Gaps 100 may then be filled with mortar or other materials so as to give the appearance of a conventionally constructed brick veneer. Another advantage and application of the embodiment shown in FIG. 6 is in spanning open areas in a wall structure, for example in forming a brick veneer over a wall section wherein only wall studs are in place. The embodiment in FIG. 6 can then span open areas between studs and retain bricks therein. Another embodiment of the multi-brick invention of FIG. 6 would have the retainer arms aligned in a desired pattern to produce a desired pattern in the retained bricks, such as, by way of example, a herringbone pattern.

Figure 7:
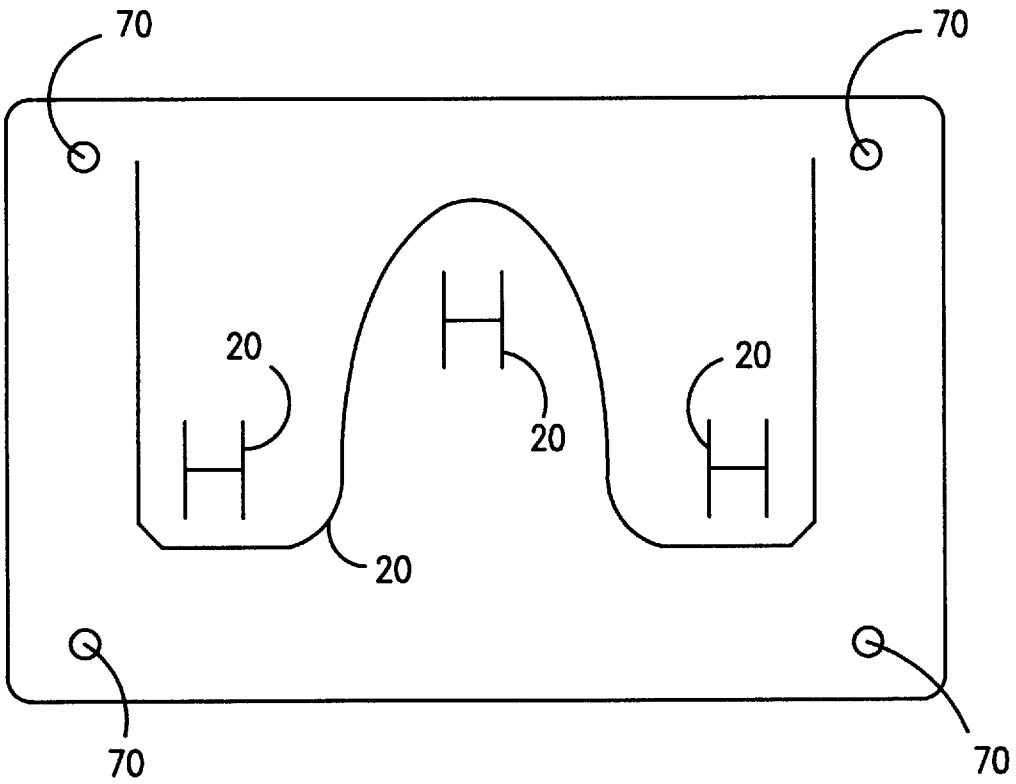
FIG. 7 is a front view of sheet material having cut-outs therein to form another embodiment of the present invention.

FIG. 7 shows sheet material with an alternate embodiment of the cut-outs, resulting in different configurations of retainer arms 30.

Figure 9:
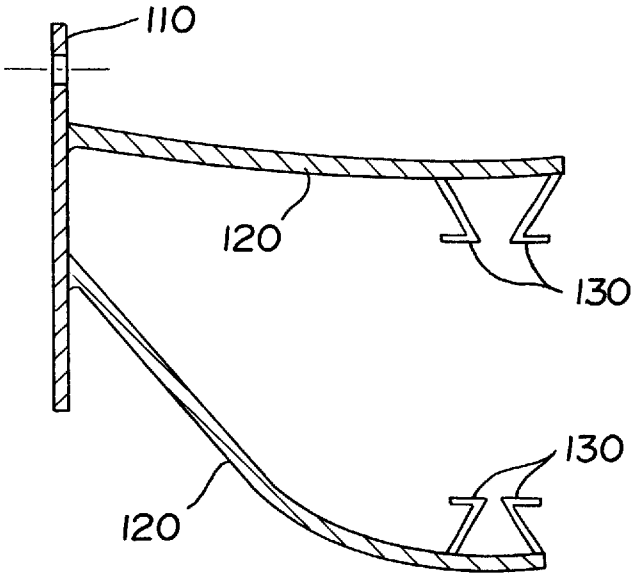
FIGS. 8 and 9 are perspective and side views, respectively, of another embodiment of the present invention.
Figure 8:
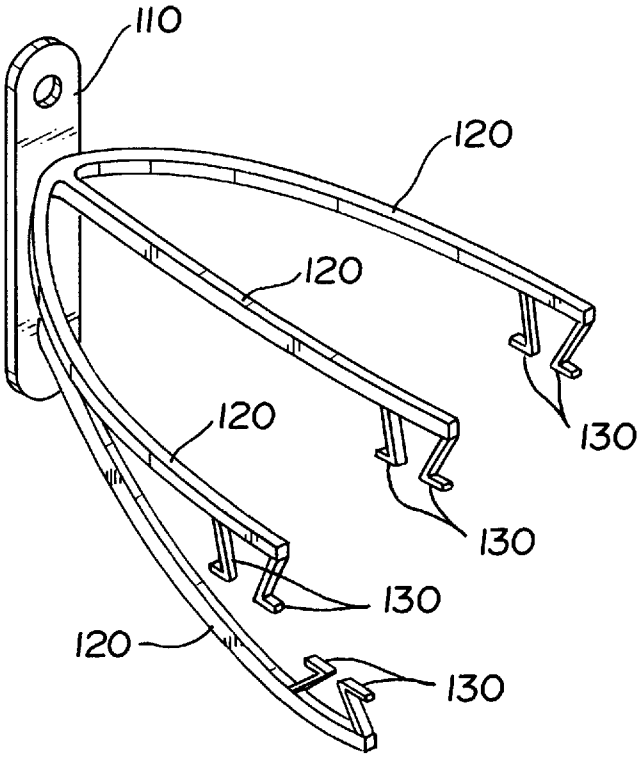

FIGS. 8 and 9 show perspective and side views of another embodiment of the apparatus. In this embodiment, base plate 110 is provided for fastening the apparatus to a wall structure with nails, screws, or other like fastening means. Multiple retainer arms 120, which by way of example total four in number in FIGS. 8 and 9, extend outwardly from base plate 110, forming a retainer space therebetween, although other numbers of arms could be provided. Prongs 130 extend from retainer arms 120 for insertion into holes in bricks or concrete building blocks for securing the blocks therebetween. By way of example, the embodiment of the present apparatus shown in FIGS. 8 and 9 could be formed of metal or plastic material, providing sufficient resilience to permit retainer arms 120 to spring outward to receive a brick, then springing back toward one another to hold the brick securely in place.

Figure 10:
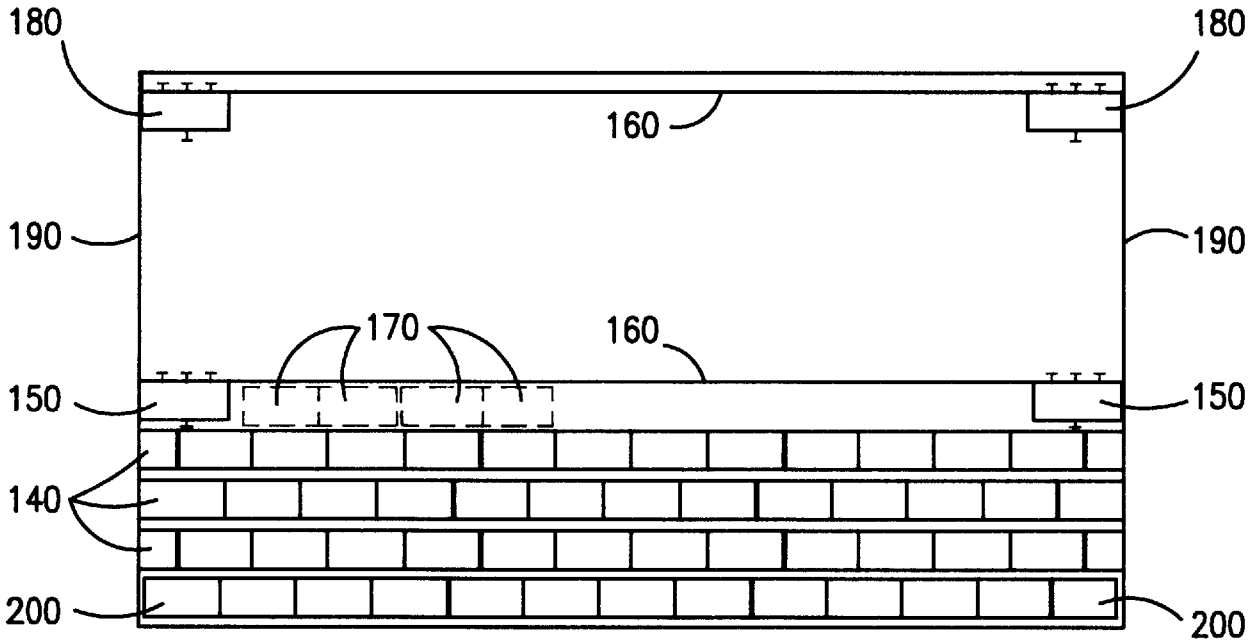
FIG. 10 is a front view schematic of a brick wall section under construction, with the apparatus used as an anchor device for horizontal and vertical alignment lines.

FIG. 10 shows the apparatus in use as a bricklaying alignment guide for interior or exterior brick walls. It is understood that any of the embodiments of the apparatus herein described could be used as an alignment guide. At the commencement of laying the brick wall, a first horizontal row of bricks is laid at the bottom of the structure, with lower corner bricks 200 held by the apparatus of the present invention. Then, two or more upper corner bricks 180 are installed at the upper corners of the wall structure, as shown in FIG. 10. Vertical plumb lines 190 are run from the upper bricks 180 to the lower corner bricks 200. In FIG. 10, several layers of bricks 140 are shown already installed. Upon commencing the next row of bricks, the apparatus is installed at either end of the wall structure in an appropriate location for mounting anchor bricks 150 therein. After anchor bricks 150 are installed in the retainer, an alignment line 160 is stretched tautly between anchor bricks 150 at an elevation even with the upper edge of anchor bricks 150. Alignment line 160 may be fastened to anchor bricks 150 or to the retainer apparatus. With alignment line 160 in place, bricks 170, represented by the dotted lines, may be then laid at an elevation even with alignment line 160. In this manner, all bricks in the row will be at an equal elevation with anchor bricks 150, and a straight, horizontal row thereby attained. In like manner, all corner bricks will be installed even with vertical plumb lines 190 to ensure that the corners will be vertical.

Other embodiments of the present invention are possible. For example, the apparatus could be made without cutouts in flat sheet material, by fastening two or more retainer arms to a base plate by welding, bolting, or other like means. Further, said retainer arms in such configuration could have any manner of cross-section shape, whether rectangular, round, oval, or other shape.

In addition to use of the apparatus to retain bricks or concrete building blocks on a wall structure, the apparatus could be modified to retain other objects such as piping, electrical conduit, and the like, in residential, commercial, or other applications.

Many modifications to the various embodiments described herein will become apparent to those skilled in the art to which this invention pertains without deviation from the spirit of the invention, which is defined by the scope of the appended claims.

I claim:

1. A brick veneer wall section, comprising:

a wall structure;

at least one brick retaining apparatus attached to said wall structure; and at least one brick held in said brick retaining apparatus, said brick having a plurality of vertical holes therethrough, said brick retaining apparatus comprising:

a) a substantially flat base plate attached to said wall structure;

b) at least two substantially flat retainer arms attached to said base plate and extending outwardly therefrom forming a retainer space therebetween, said retainer space having a vertical dimension sufficient to closely engage said brick between said retainer arms, a lower of said retainer arms forming a substantially flat platform for supporting at least half of the depth of said brick thereon; and c) at least one prong connected to each of said retainer arms and extending therefrom into said retainer space, said retainer arms and said prongs spaced so that each of said prongs enters one of said vertical holes in said brick.

2. The brick veneer wall section of claim 1, wherein multiple of said brick retaining apparatus are provided, and wherein said multiple brick retaining apparatus are spaced so as to create a gap between adjacently-mounted bricks of sufficient size to fill with mortar, thus creating the appearance of a conventionally constructed brick veneer.

3. A method for constructing brick wall sections, comprising the steps of:

providing an apparatus comprising:

a base plate;

at least two retainer arms attached to said base plate and extending outwardly therefrom forming a retainer space therebetween; and at least one prong connected to each of said retainer arms and extending therefrom into said retainer space;

mounting one of said apparatus at upper and lower corners of a wall structure;

mounting a brick in each of said apparatus, said bricks mounted so as to form an outline of a rectangle, said outline of said rectangle having two horizontal lines and two vertical lines;

fastening an alignment line to each of said apparatus and stretching said alignment line therebetween, forming two horizontal and two vertical alignment lines;

placing additional bricks in a row between said bricks mounted in said apparatus, said additional bricks placed at an elevation equal to that of said alignment line, thereby forming a row of bricks at an equal elevation to said bricks mounted in said apparatus and aligned with said vertical alignment lines; and sequentially adding rows of bricks to achieve a desired height of brick wall.

* * * * *